US006408080B1

(12) United States Patent
Koizumi

(10) Patent No.: US 6,408,080 B1
(45) Date of Patent: Jun. 18, 2002

(54) BOUNDARY LAYER MICROPHONE

(75) Inventor: David H. Koizumi, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/450,298

(22) Filed: Nov. 29, 1999

(51) Int. Cl.[7] ..... H04R 25/00

(52) U.S. Cl. ..... 381/160; 381/161; 381/356; 181/187

(58) Field of Search ..... 381/160, 161, 381/355, 356, 357, 358, 360, 361, 369, FOR 147, FOR 148; 181/171, 187

(56) References Cited

U.S. PATENT DOCUMENTS 1,732,722 A * 10/1929 Horn ..... 381/356
2,017,122 A * 10/1935 Hanson ..... 381/160
3,881,056 A * 4/1975 Gibson et al. ..... 381/361

* cited by examiner

*Primary Examiner*—Huyen Le
*Assistant Examiner*—Suhan Ni
(74) *Attorney, Agent, or Firm*—Trop, Pruner & Hu, P.C.

(57) ABSTRACT

A microphone may use boundary layer technology in concert with a concave reflector to produce improved sensitivity. The concave reflector may be arranged with respect to a boundary layer creating surface such that the sound waves are concentrated at the boundary layer creating surface. Thus, an intense compression layer is formed proximate to the boundary layer creating surface. A transducer may arranged in opposition to the boundary layer creating surface to convert the boundary layer energy into an electrical signal.

13 Claims, 3 Drawing Sheets

BOUNDARY LAYER MICROPHONE

BACKGROUND

This invention relates generally to microphones and particularly to boundary layer or pressure zone microphones.

A boundary layer or pressure zone microphone is a microphone which is situated proximate to a boundary layer or pressure zone created by a reflecting surface. Sound waves create a high pressure region directly in front of a sound reflecting surface. The incident and reflected waves from a reflecting surface are superimposed in the same phase. Thus, the pressure in front of the surface may be twice as high as in the free sound field. This effect is utilized in so-called boundary layer or pressure zone microphones. In one embodiment of such microphones, an electrical transducer is mounted on a flat, reflecting surface. The increased acoustic pressure is then detected by the microphone in the region proximate to the reflecting surface.

The pressure zone or zone of increased pressure is at a maximum at a distance of half the sound wavelength from the reflecting surface. Thus, microphones built into the reflecting surface may have a sensitivity that is twice the value that the microphone would have without the,reflecting surface.

Conventional microphones may also be used with sound reflectors which concentrate the sound at the transducer. For example, a parabolic reflector may be utilized with a rearwardly facing transducer located at the focal point of the parabolic reflector. The transducer then receives the concentrated sound waves from the reflector and converts them into an electrical signal. One problem with this approach is that such microphones are particularly prone to feedback effects.

Thus, there is a need for improved microphones that take advantage of the acoustic gain achievable using a boundary layer or pressure zone.

SUMMARY

In accordance with one aspect, a microphone may include a concave reflector. A boundary layer creating surface is opposed to the concave reflector.

Other aspects are set forth in the accompanying detailed description and claims.

DETAILED DESCRIPTION

Figure 1:
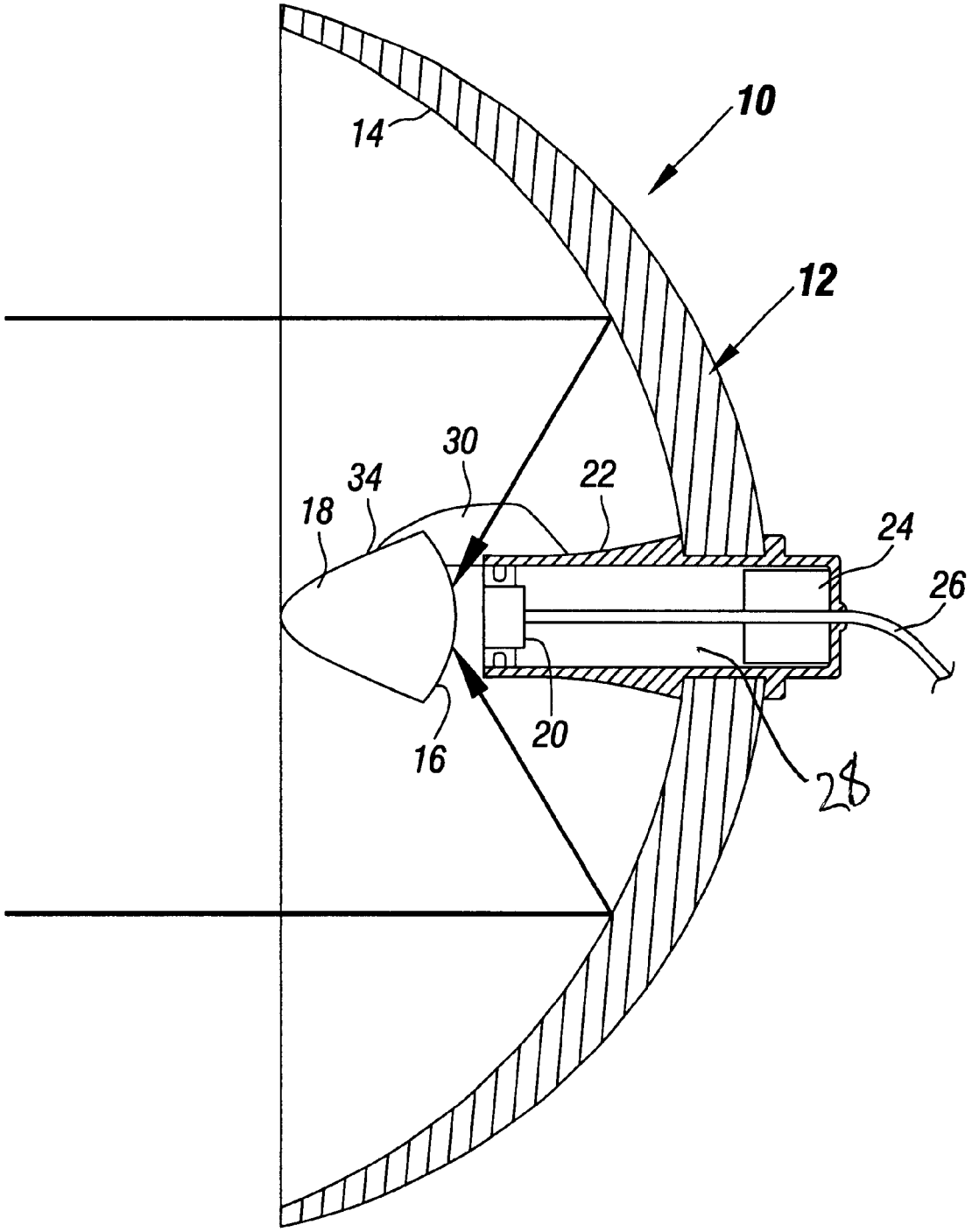
FIG. 1 is a cross-sectional depiction of a pressure zone microphone in accordance with one embodiment of the present invention.

Referring to FIG. 1, a microphone 10 may include a concave reflector 12 which in one embodiment of the present invention may have a parabolic reflecting surface 14. In a low cost application, the reflector 12 may be formed of plastic. A boundary layer creating surface 16 is formed on element 18. The element 18 may be situated near the focal point of the surface 14. Thus, acoustic waves are concentrated by the surface 14 at the surface 16. As a result, a compression layer is formed proximate to the surface 16 that creates a boundary layer or pressure zone effect.

Thus, the surface 14 may be forwardly facing in the sense that it faces the source of sound. Conversely, the surface 16 is opposed to the surface 14 and is rearwardly facing. A electrical transducer 20 is arranged in close juxtaposition to the surface 16 and is forwardly facing in one embodiment of the present invention. In one embodiment of the present invention, the transducer 20 may be situated in the boundary layer or pressure zone created by the surface 16. The surface 16 is then situated just rearwardly of the focus of the surface 14.

Any of variety of conventional microphones may be used as the transducer 20 including a conventional condenser microphone. The transducer 20 may be mounted in a housing 22 having a chamber 24 which may be sealed. Wires 26 passing through the chamber 28 may exit rearwardly from the housing 24 through a foam sealant 24.

In one embodiment of the present invention, the element 18 is mounted on the housing 22 by a connector 30. Advantageously, the connector 30 positions the element 18 near the focus of the reflecting surface 14. The element 18 may have a surface which is a portion of a sphere and a surface 34 which is conical. As a result, the element 18 may have a tear-drop shape in one embodiment of the present invention.

When the reflector 12 is pointed at a sound source, acoustic waves, indicated by arrows in FIG. 1, are reflected off the surface 14 toward its focus, located near the surface 16. Thus, sound wave energy is concentrated by the reflector 12 at the surface 16. As a result, an intense boundary layer is created proximate the surface 16.

Figure 2:
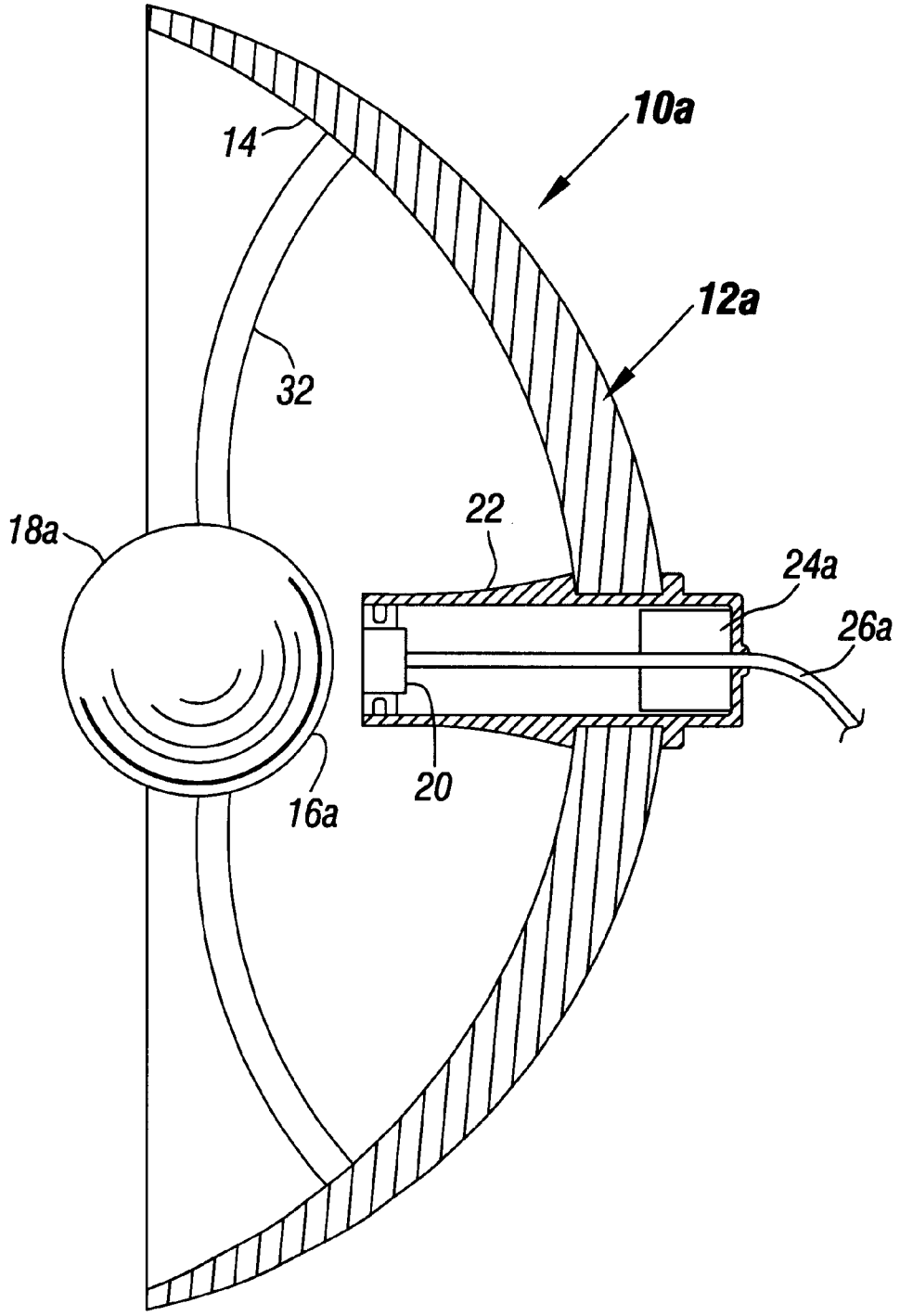
FIG. 2 is a cross-sectional view corresponding to FIG. 1 of another embodiment of the present invention.

While the element 18 is illustrated as tear-drop shaped, other shapes may be used as well. For example, as shown in FIG. 2, a spherical element **18*a* may be supported on supports 32 which are secured to the surface 14. The element 18 may also be formed as a flattened sphere or a hemisphere as additional examples. It is desirable that the surface 16 be curved. In addition, it is advantageous that the surface 34 also be curved. The surface 34 may be effective to dissipate the compression wave built up upon the surface 16**.

In order to detect human speech, the reflector 12 may have a diameter of from about eight to twelve inches in accordance with one embodiment of the present invention. It may have a depth of about three inches, and the spacing between the surface 16 and the transducer 20 may be from about 0.1 to ⅛ of an inch. The ratio of the focal distance to the diameter of the reflector 12 may be from 30 to 50 percent so as to create a relatively narrow field of acoustic focus which may be effective over relatively long distances, in one embodiment of the invention.

As shown in FIG. 2, the spherical element **18*a* may be positioned with its center at the focus of the reflector 12 which may be a portion of a parabola. The spherical element 18*a*** may be effective in creating reduced diffractive effects in the resulting compression layer or region of high acoustic intensity.

Figure 3:
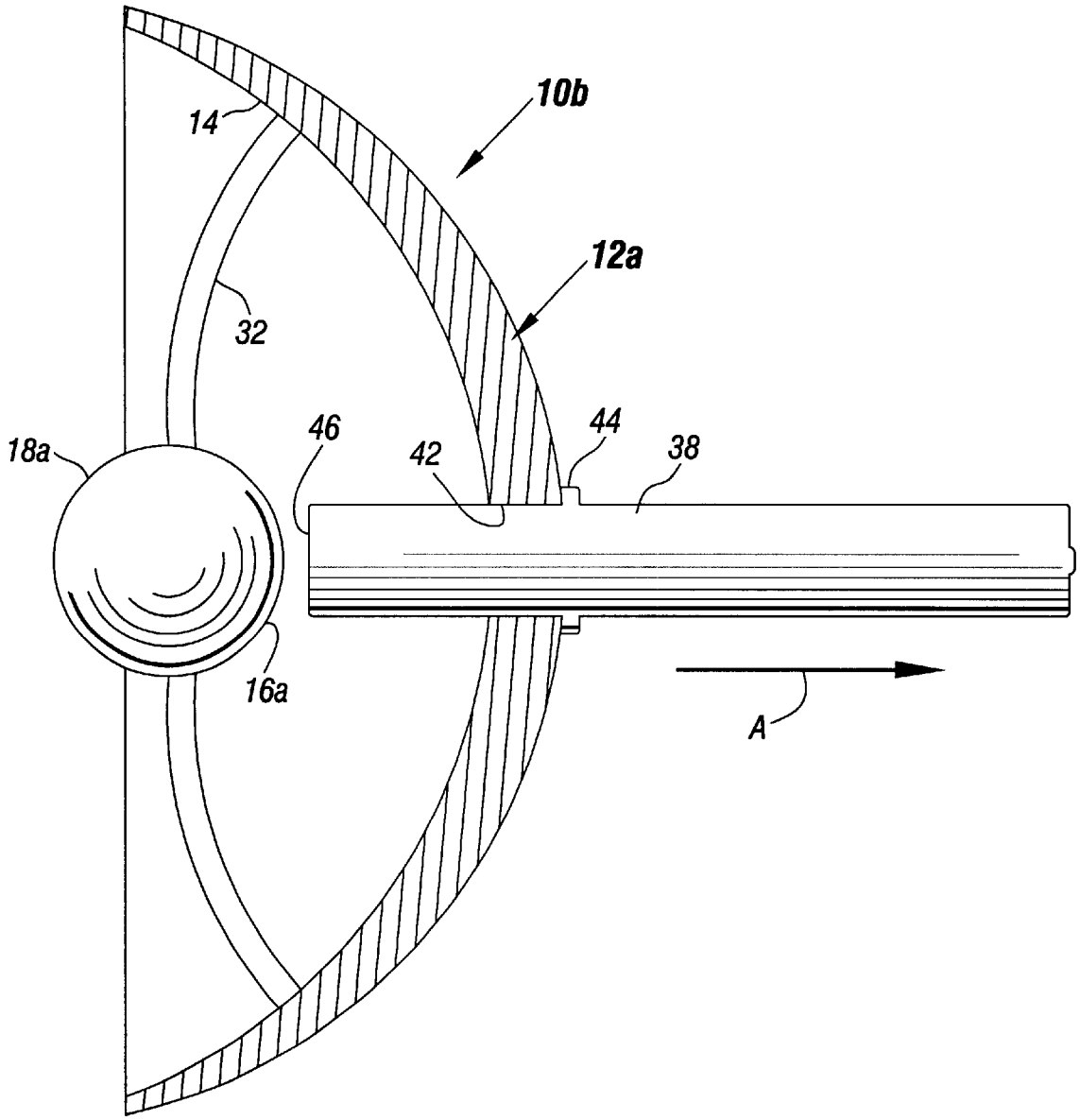
FIG. 3 is a cross-sectional view corresponding to FIG. 2 of still another embodiment of the present invention.

Referring to FIG. 3, in still another embodiment of the present invention, the reflector **12*a* may be adapted to removably receive a shotgun microphone 38**. A shotgun microphone is a narrow recording angle microphone that transduces sounds with different intensities depending on the angle from which the sound waves arrive at the microphone. The shotgun microphone is a tubular interference transducer. Sound coming straight into the microphone travels straight through its tubular body but all other sounds create interference and phase cancellation.

The shotgun microphone 38 may removably, telescopically plug into a opening 42 in the reflector 12. A stop 44 may be positioned on the tubular shotgun microphone 38 to position the end 46 of the shotgun microphone 38 at a desired position with respect to the boundary layer creating surface 16a.

In such case, the reflector 12*a* may completely enclose the phase cancellation openings of the shotgun microphone 38, in one embodiment of the present invention. In this configuration, the microphone 10*b* is extremely specific, receiving sounds from sources at which the microphone 10*b* is specifically aimed. For example, in some embodiments of the present invention, the microphone's acceptance angle may be about five degrees or less so that whispers may be clearly picked up at distances on the order of a eighty feet.

At the same time, because the shotgun microphone 38 is removable from the reflector 12*a* (as indicated by the arrow A), it may be used independently of the reflector 12*a* in some cases. For example, the shotgun microphone 38 may be relatively angle specific, with an acceptance angle of forty degrees. Such microphones are typically used to focus in on a person's voice at distances of about four feet.

Thus, in some embodiments of the present invention, the microphone lob may be utilized in a video conference setting. The shotgun microphone 38 may be used without the reflector 12*a* when general conversation is taking place and may be used with the reflector 12*a* to focus on speech from a particular participant who is speaking to the group at other times. Thus, a relatively flexible microphone may be provided which advantageously benefits from boundary layer technology.

The microphone may show improved results compared to conventional microphones which are adversely affected by reverberations in the room. In other words, conventional microphones pick up not only the reverberations of the human speech from surrounding walls but the speech as well. Embodiments of the present invention may be focused on a particular user, thereby selectively picking up the person's speech independently from the reverberations.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A microphone comprising:

a concave reflector;

a boundary layer creating surface opposed to said concave reflector; and an electrical transducer arranged in the boundary layer created by said boundary layer creating surface.

2. The microphone of claim 1 further including an electrical transducer arranged near said surface.

3. The microphone of claim 1 wherein said concave reflector includes a parabolic reflecting surface arranged in opposition to said boundary layer creating surface.

4. The microphone of claim 1 wherein said boundary layer creating surface is a curved surface.

5. The microphone of claim 4 wherein said boundary layer creating surface is spherical.

6. The microphone of claim 5 wherein said boundary layer creating surface is formed on a sphere.

7. The microphone of claim 1 wherein said boundary layer creating surface is formed on a teardrop shaped element.

8. The microphone of claim 2 wherein said transducer is part of a shotgun microphone.

9. The microphone of claim 8 wherein said shotgun microphone telescopically and removably engages said reflector.

10. The microphone of claim 9 including a stop to position one end of said shotgun microphone proximate to said boundary layer creating surface.

11. The microphone of claim 1 wherein said boundary layer creating surface is positioned proximate to the focal point of said concave reflector.

12. The microphone of claim 1 including an element, said boundary layer creating surface is formed on said element, said element having another surface which dissipates the boundary layer.

13. The microphone of claim 2 wherein said transducer is sufficiently close to said surface to lie in the boundary layer when said microphone is in use.

* * * * *